US010962175B2

(12) United States Patent
Belgacem-Strek et al.

(10) Patent No.: US 10,962,175 B2
(45) Date of Patent: Mar. 30, 2021

(54) METHOD AND SYSTEM FOR CALCULATING, IN REAL-TIME, THE DURATION OF AUTONOMY OF A NON-REFRIGERATED TANK CONTAINING LNG

(71) Applicant: ENGIE, Courbevoie (FR)

(72) Inventors: Michel Ben Belgacem-Strek, Paris (FR); Yacine Zellouf, Asnieres sur Seine (FR); Frédéric Legrand, Paris (FR)

(73) Assignee: ENGIE, Courbevoie (FR)

( * ) Notice: Subject to any disclaimer, the term of this patent is extended or adjusted under 35 U.S.C. 154(b) by 248 days.

(21) Appl. No.: 16/063,612

(22) PCT Filed: Dec. 16, 2016

(86) PCT No.: PCT/FR2016/053518
§ 371 (c)(1),
(2) Date: Jun. 18, 2018

(87) PCT Pub. No.: WO2017/103531
PCT Pub. Date: Jun. 22, 2017

(65) Prior Publication Data

US 2019/0003650 A1 Jan. 3, 2019

(30) Foreign Application Priority Data

Dec. 18, 2015 (FR) ..... 1562854

(51) Int. Cl.
*F17C 13/02* (2006.01)

(52) U.S. Cl.
CPC ..... *F17C 13/025* (2013.01); *F17C 13/026* (2013.01); *F17C 2201/01* (2013.01);
(Continued)

(58) Field of Classification Search
CPC .... F17C 13/025; F17C 13/026; F17C 13/028; F17C 2201/0104; F17C 2201/0128;
(Continued)

(56) References Cited

U.S. PATENT DOCUMENTS 5,518,140 A * 5/1996 Lenz ..... F17C 9/00 220/528
7,104,124 B2 9/2006 Stabile et al.
(Continued)

FOREIGN PATENT DOCUMENTS

EP 1145740 10/2001
EP 1965121 9/2008
(Continued)

OTHER PUBLICATIONS

International Search Report from International Application No. PCT/FR2016/053518, dated Apr. 4, 2017.
(Continued)

*Primary Examiner* — Catherine T. Rastovski
(74) *Attorney, Agent, or Firm* — Davidson, Davidson & Kappel, LLC

(57) ABSTRACT

This invention relates to a method and a system for calculating in real-time the duration of autonomy of a non-refrigerated tank containing natural gas comprising a liquefied natural gas (LNG) layer and a gaseous natural gas (GNG) layer. This invention also relates to a system for calculating, in real time, according to the method of the invention, the duration of autonomy of a non-refrigerated tank, as well as a vehicle comprising an NG tank and a system according to the invention.

4 Claims, 5 Drawing Sheets

(52) U.S. Cl.
CPC ..... *F17C 2201/0104* (2013.01); *F17C 2201/0128* (2013.01); *F17C 2201/0157* (2013.01); *F17C 2201/056* (2013.01); *F17C 2201/058* (2013.01); *F17C 2205/0332* (2013.01); *F17C 2221/033* (2013.01); *F17C 2223/0153* (2013.01); *F17C 2223/0161* (2013.01); *F17C 2223/0169* (2013.01); *F17C 2223/033* (2013.01); *F17C 2223/035* (2013.01); *F17C 2250/032* (2013.01); *F17C 2250/043* (2013.01); *F17C 2250/0439* (2013.01); *F17C 2250/0452* (2013.01); *F17C 2250/0473* (2013.01); *F17C 2250/0491* (2013.01); *F17C 2250/0495* (2013.01); *F17C 2260/021* (2013.01); *F17C 2260/026* (2013.01); *F17C 2260/044* (2013.01); *F17C 2265/031* (2013.01); *F17C 2270/0105* (2013.01); *F17C 2270/0165* (2013.01); *F17C 2270/0168* (2013.01); *F17C 2270/0173* (2013.01)

(58) Field of Classification Search
CPC ..... F17C 2201/0157; F17C 2201/056; F17C 2201/058; F17C 2205/0332; F17C 2221/033; F17C 2223/153; F17C 2223/0161; F17C 2223/0169; F17C 2223/033; F17C 2223/035; F17C 2260/021; F17C 2260/026; F17C 2260/044; F17C 2265/031; F17C 2270/0105; F17C 2270/0165; F17C 2270/0168; F17C 2270/0173
See application file for complete search history.

(56) References Cited

U.S. PATENT DOCUMENTS

| | | | | |
|---|---|---|---|---|
| 9,874,469 | B2 | 1/2018 | Bacot et al. | |
| 2002/0170347 | A1 | 11/2002 | Stabile et al. | |
| 2007/0193379 | A1 | 8/2007 | McCluskey | |
| 2012/0267002 | A1* | 10/2012 | Kittilsen | F17C 5/06 141/4 |
| 2014/0333444 | A1* | 11/2014 | Grant | G01M 3/3254 340/605 |
| 2015/0120166 | A1* | 4/2015 | Fisher | B61C 17/02 701/101 |
| 2016/0061802 | A1* | 3/2016 | Criel | B60K 15/03 73/40 |
| 2016/0290561 | A1* | 10/2016 | Whiteman | F17C 5/007 |
| 2017/0114961 | A1* | 4/2017 | Baune | F17C 13/04 |

FOREIGN PATENT DOCUMENTS

| | | |
|---|---|---|
| FR | 2868160 | 9/2005 |
| FR | 2952432 | 5/2011 |
| JP | H0769084 | 3/1995 |
| JP | H07189731 | 7/1995 |
| JP | 2003130296 | 8/2003 |
| JP | 2005280973 | 10/2005 |
| JP | 2006200564 | 8/2006 |
| JP | 2007162849 | 6/2007 |
| JP | 2011080363 | 4/2011 |

OTHER PUBLICATIONS

English Translation of a Japanese Office Action dated Oct. 27, 2020 from corresponding Japanese Application No. 2018-532050.

* cited by examiner

METHOD AND SYSTEM FOR CALCULATING, IN REAL-TIME, THE DURATION OF AUTONOMY OF A NON-REFRIGERATED TANK CONTAINING LNG

This application is a U.S. national phase application under 35 U.S.C. of § 371 of International Application No. PCT/FR2016/053518, filed Dec. 16, 2016, which claims priority of French Patent Application No. 1562854, filed Dec. 18, 2015, the disclosures of which are hereby incorporated by reference herein.

This invention generally relates to a method and a system for calculating in real-time the duration of autonomy of a non-refrigerated tank containing natural gas (usually designated by the acronym NG), comprising a liquefied natural gas (LNG) layer and a gaseous natural gas (GNG) layer.

The term duration of autonomy of a non-refrigerated tank containing NG, means, in terms of this invention, the remaining retention time (or storage time) of the natural gas in the tank before opening of the valves of the tank.

Liquefied natural gas (abbreviated as LNG) is typically natural gas comprised substantially of condensed methane in the liquid state. When it is cooled to a temperature of about −160° C. at atmospheric pressure, it takes the form of a clear, transparent, odourless, non-corrosive and non-toxic liquid. In a tank containing LNG, the latter generally has the form of a liquid layer, which is covered by a layer of gas ("tank roof").

LNG carburant is a simple and effective alternative to conventional fuels. Whether from the point of view of the emission of $CO_2$, or polluting particles and energy density. An increasing number of actors are turning to the use thereof, in particular road, sea or rail transporters.

However, one of the intrinsic faults of LNG is its quality as a cryogenic liquid at atmospheric pressure. This means that the LNG has to be maintained at a temperature well below the ambient temperature in order to remain in liquid state. This implies inevitable heat inputs in the non-refrigerated tank of LNG and as such an increase in pressure in the gaseous layer until the opening of the valves of the tank. This increase in pressure limits the duration of autonomy of the LNG in the tank.

However, the duration of autonomy is a parameter that it is crucial to know, so as to dimension the logistics chain, and in particular the transport chain of the LNG and to inform the operator in real time of the residual duration of autonomy (in the same way as the duration of autonomy of a battery is generally communicated to its user). When such information is not communicated to the operators of an LNG tank, this has the consequence for example of discharges of methane into the atmosphere which are incompatible with current environmental requirements.

Currently, no solution is known to inform in real time the operator of the duration of autonomy (or retention time) of a tank of LNG before the opening of the valves. The only information available to the operator is the pressure of the tank roof (i.e. the superficial layer of gas in the tank). The operator consequently follows the rules of good conduct deduced from experience and provided by the tank manufacturer in order to prevent a discharge of gas into the atmosphere.

The current safety standards (in particular those given by the "*American Society of Mechanical Engineers*", the "*International Maritime Organization*", the "*European Agreement concerning the International Carriage of Dangerous Goods by Road*", and the "*International Maritime Dangerous Goods*") impose upon tank manufacturers to calculate and to measure a maximum retention time in certain precise conditions of filling, of temperature and of pressure specific to each standard. This maximum retention time is currently the reference in the studies for dimensioning logistics chains. However, this is not information in real time concerning the duration of autonomies of the tank and the absence of this information in real time is problematic for several reasons:

- a lack of flexibility is observed in the logistics chain: indeed, the maximum retention times are calculated upstream of the elaboration of the logistics chain. In unexpected circumstances, the customer or the operators do not have tools available to support them in the choices to be made;
- the management of unbalanced LNG is not taken into account: indeed, a LNG is not necessarily in the state of equilibrium with its gaseous phase, contrary to the cases taken into account in the current standards. A state of disequilibrium could surprise the operator. For example in the case of a sub-cooled LNG, the increase in pressure could sharply increase once the equilibrium temperature is reached. This equilibrium temperature cannot obviously be calculated by the operator; It is necessary for all operators who have to manage LNG to have received suitable training in manipulating LNG and in good practices. This is the case of the current actors in the market, who are mostly professionals who have received such training and who are also initiated in good practices. But this is possible because the current market of LNG fuel is of relatively small size. However, if the market were to increase rapidly, actors with less training would be put into relation with LNG. Knowing the time before the venting could substantially assist these new actors in their management of LNG.

In conclusion, the objective today is, in order to ensure the development of LNG as a fuel, to set up a solution that makes it possible to predict the behaviour thereof better in real time. The obligation of working in a pre-established straightjacket is one of the technological locks that currently benefits its direct competitors such as diesel.

In order to achieve the aforementioned objective, the applicant has developed a method and system for calculating in real time the duration of autonomy of a non-refrigerated tank containing LNG, which makes it possible to instantaneously provide the duration of autonomy of a tank of LNG according to:

- on the one hand thermodynamic parameters of the LNG measured inside the tank by sensors inside the tank (temperatures and compositions of the liquid and of the gas, pressure of the gaseous LNG and proportion of the liquid LNG in the tank), and
- on the other hand data concerning the tank (shape, dimensions, pressure for calibrating the valves of the tank, and boil off (BOR).

This invention therefore has for object a method for calculating in real time the duration of autonomy of a non-refrigerated tank and defined by a set pressure of the valves n valve its shape and its dimensions, as well as its boil off rate (BOR, input data concerning the tank), said tank containing natural gas (NG) being divided into:

- a layer of natural gas in liquid state (LNG), defined at a given instant t by its temperature $T_{liq}(t)$, its composition $x_{liq}(t)$, and the filling rate of the tank by said natural gas layer in the liquid state (thermodynamic parameters relative to the NG in the liquid state);

a natural gas layer in gaseous state (GNG), defined at a given instant t by its temperature $T_{gas}(t)$ and its composition $x_{gas}(t)$, and a pressure p(t) (thermodynamic parameters relative to the NG in the gaseous state);

said method being characterised in that it consists of an algorithm comprising the following steps:

A. at an instant $t_0$, the physical parameters of said liquefied natural gas layers are initialised, by measuring using pressure and temperature sensors, the pressure of the gas $p(t_0)$, and the temperature of the liquid $T_{liq}(t_0)$, while the respective compositions of the liquid $x_{liq}(t_0)$ and gaseous $x_{gas}(t_0)$ phases are known input data corresponding either to the respective compositions of the liquid and gaseous phases at the time of the loading of the tank, or to average compositions for the type of LNG used;

B. for each instant t greater than $t_0$, a predetermined volume V of natural gas is subtracted in the gaseous or liquid state corresponding to the operating state of the tank at this instant t (if this tank is transported by vehicle that is stopped, V=0, otherwise V corresponds to the consumption of the vehicle in NG); and a calculation is made, based on the volume of natural gas remaining after subtraction, of the physical parameters p(t), $T_{gas}(t)$, and $T_{liq}(t)$, using equations based on the conservation of the mass and of the energy of the liquid and gaseous natural gas contained in the tank;

C. as long as the pressure p(t) is less than $p_{valve}$, the calculation of the step B is reiterated for the following instant t+δt, with a constant physical time step δt (in particular of about one minute, according to the heat flows, and time constants of the thermodynamic equilibriums).

D. as soon as during the N iterations of the calculation process of p(t), p(t+δt), . . . , p(t+N*δt), the pressure p(t+N*δt) becomes greater than or equal to $p_{valve}$, the calculation is stopped;

E. the duration of autonomy sought is equal to the total duration N*δt elapsed by the algorithm at the moment of the stoppage of the calculation.

The tank can operate in an open system (transported in this case by a vehicle in operation) or closed system (transported in this case by a vehicle that is stopped or not transported).

The method according to the invention is shown in FIG. 2.

With regards to the input data concerning the tank, the latter can have various forms, for example prismatic, cylindrical, or spherical. Its dimensions can be typically of about 1.5 m in length and 0.5 m in diameter for a cylindrical tank. The set pressure of the valves of the tank $p_{valve}$ is given by the manufacturer of the LNG tank. It is typically of about 16 bars for a reservoir with 300 litres in volume and can even range up to 25 bars.

The term boil off rate means, in terms of this application, the equivalent volume of liquid that would be boiled off per day due to the inputs of heat in the case where the tank would be open. This is also a specific value of the tank, usually given by the manufacturer.

With regards to the thermodynamic parameters relative to the NG, it is assumed that the liquefied natural gas contained in the tank is divided into a layer of natural gas in liquid state and a natural gas layer in gaseous state, as shown in FIG. 1. Each layer is defined at each instant t by its temperature $T_{liq}(t)$ and $T_{gas}(t)$ (respectively for the layer of LNG in the liquid state and the layer of LNG in the gaseous state) and its composition $x_{liq}(t)$ and $x_{gas}(t)$ (respectively for the layer of LNG and the layer of GNG).

The gaseous phase (i.e. the natural gas layer in the gaseous state) is more specifically characterised by its pressure p(t), which is calculated at each instant t by the Peng-Robinson equation of state[(1)], while the liquid phase (i.e. the natural gas layer in the liquid state) is more specifically characterised by the rate of filling z of the tank by the natural gas layer in the liquid state, which is typically of about 80 to 90% in volume after loading of the tank and at the end of autonomy, of about 10 to 20% in volume.

The compositions $x_{liq}(t)$ and $x_{gas}(t)$ are vectors giving the mass fraction of each components of LNG (usually the mass fraction of $CH_4$, $C_2H_6$, $C_3H_8$, $iC_4H_{10}$, $nC_4H_{10}$, $iC_5H_{12}$, $nC_5H_{12}$, $nC_6H_{14}$ and $N_2$ in each one of the gaseous or liquid phases of the LNG). Note that the liquid phase and the gas phase are not necessarily in thermodynamic equilibrium: indeed the compression of the gaseous phase during filling can induce a delay in the thermal exchanges between the two phases (liquid in the over-cooled state).

The method of calculation according to the invention consists of an algorithm (or behaviour code of the NG) comprising various steps A to D. This code (or algorithm) takes into account several physical phenomena (details hereinafter), that affect the pressure:

Compressibility of the gas,
Entry of heat via conduction,
Entry of heat via radiation,
Evaporation of the LNG.

The behaviour code of the NG is of the iterative type, i.e. it calculates the change in the pressure at each physical time step δt until the opening of the valves.

The first (step A) consists in the initialisation, at an initial instant $t_0$, of the physical parameters of said layers of liquefied natural gas, via the measurement (continuously) using pressure and temperature sensors, of the pressure of the gas $p(t_0)$, and the temperature of the liquid $T_{liq}(t_0)$. On the other hand, the respective compositions of the liquid phases $x_{liq}(t_0)$ and gaseous phases $x_{gas}(t_0)$ are known input data corresponding either to the respective compositions of the liquid and gaseous phases at the time of the loading of the tank, or to average compositions for the type of LNG used.

Then, for each instant t greater than $t_0$, a predetermined volume V of natural gas is subtracted in the gaseous or liquid state corresponding to the operating state of the tank; then a calculation is made, during the step B, of the physical parameters p(t), T gas (t) and $T_{liq}(t)$, using equations based on the conservation of the mass and of the energy of the liquid and gaseous natural gas contained in the tank.

These equations, of which details are provided hereinafter, are based on the assumption that the non-refrigerated tank is considered to be a closed system: the mass conservation equations are therefore complementary between the gas phase and the liquid phase, and the surface evaporation is considered as the only phenomenon allowing for a transfer of mass.

The calculation of the mass of liquid is carried out by taking into account the rate of filling z of the tank by the natural gas and the density of the LNG at the temperature of the liquid $T_{liq(t)}$.

The change in the mass of the gaseous phase can be given by the relationship (1):

$$\frac{\partial}{\partial t} m_i = m_{Ev} * x_{Ev,liq,i} \tag{1}$$

with:

$m_i$ designating the mass flow rate of a component i of the natural gas (see further on the paragraph concerning the surface evaporation in the portion of the description describing the physical phenomena to be taken into consideration in the behaviour law), and $x_{Ev,liq,i}$ designating the mass fraction of the component i associated with the evaporation of the LNG at the free surface of the liquid layer (in other terms, the interface between the liquid and gaseous faces).

The power conservation equation used for the liquid phase can be given by the relationship (2):

$$\frac{\partial}{\partial t} h_{liq} = \phi_{Cond}^{liq} + \phi_{Ray} - \phi_{Ev} \tag{2}$$

with:

$h_{liq}$ designating the total enthalpy of the liquid phase, $\phi$ designating the heat flow associated with each phenomenon acting on the LNG:

$\phi^{liq}_{Cond}$ designating in particular the parasite heat inputs via conduction through the wet walls of the tank (side and bottom), $\phi_{Ray}$ designating in particular the incident radiation of the gaseous phase (upper layer of the tank), and $\phi_{Ev}$ designating the flow of LNG evaporated at the free surface of the layer of liquid LNG.

The power conservation equation of the gaseous phase can be given by the relationship (3):

$$\frac{\partial}{\partial t} h_{gaz} = \phi_{Ev} + \phi_{Cond}^{gaz} \tag{3}$$

with:

$h_{gaz}$ designating the total enthalpy of the gaseous phase, and $\phi_{Ev}$ being such as defined hereinabove, and $\phi^{gaz}_{Cond}$ designating in particular the parasite heat inputs via conduction through the dry walls of the tank (side and bottom).

As indicated hereinabove, the pressure p(t) of the gaseous phase can be calculated by the Peng-Robinson equation[1].

The temperatures of the gas and of the liquid, respectively $T_{gas}(t)$ and $T_{liq}(t)$, can be determined by the thermal capacity at a constant volume Cv of each phase, which can be given by the relationship (4):

$$T(t) = \frac{h}{C_v} \tag{4}$$

with:

T(t) designating the temperature of the phase considered calculated at the instant t, h designating the enthalpy of the phase considered, and Cv the thermal capacity at a constant volume of the phase considered.

The main physical phenomena that affect the pressure p(t), which are taken into account in the calculation of the duration of autonomy of the tank according to the method according to the invention, can in particular include the compressibility of the gas, the entry of heat via conduction, the entry of heat via radiation, and the evaporation of the LNG. Details of these phenomena are detailed hereinafter:

Surface Evaporation

It is considered that the heat exchanges and of mass between the liquid phase and the gas phase are piloted by a surface evaporation law, of which the engine is the difference between the core of the LNG stored in the liquid state and its free surface. The pressure p(T) in the gaseous phase of the tank affects the surface evaporation by influencing the equilibrium temperature of the NG at the liquid/vapour surface corresponding to this pressure. The temperature of the free surface of the LNG is assumed to be equal to the equilibrium temperature of the LNG.

The evaporation in a tank of NG at rest is a local phenomenon which occurs on the surface. The change in phase is relatively "gentle" (i.e. without boiling and in a relatively thin limit layer) and occurs without boiling. In the algorithm of the method according to the invention, a law based on the laws of natural turbulent convection can be used, which can in particular be of the form[2]:

$$q_{ev} = K \cdot (\Delta T_{overheat})^{\alpha} \tag{5}$$

with:

K designating a constant relative to the LNG which is always positive, $\Delta T_{overheat}$ designating the overheating that is produced during the evaporation phenomenon in the tank of LNG, $q_{ev}$ designating the standardised evaporation rate of LNG, and $\alpha$ designating a coefficient relative to the LNG, with $1 \leq \alpha \leq 2$.

Thermal Conduction on Walls

For the heat exchanges with the wall, a uniform and constant parietal flow can be considered. The value of the flow is an input magnitude of the calculation, it is directly connected to the boil off rate (BOR) according to the criteria of the manufacturers.

Thermal Radiation of the Walls

Vertical non-wet walls can also be the seat of the thermal flows, which have for effect to heat the gaseous phase, but also contribute to the heating of the liquid via radiation.

In order to take into account the contribution of the gaseous phase in the heating of the liquid, a simple model can be used that establishes a radiation balance over all of the surfaces, i.e. the free surface of the LNG (interface) and the non-wet surfaces of the tank (surfaces of the tank in contact only with the gaseous phase of the NG in the tank). Details of the assumptions of this model are provided hereinbelow:

the free surface is assumed to be flat at the saturation temperature of the LNG. This surface is on the other hand assumed to be black with $\varepsilon=\alpha=1$, $\rho=0$, $\varepsilon$ being the emissivity, $\alpha$ the absorption factor, and $\rho$ designating the reflection factor, the vertical walls of the tank are assumed to be at a constant temperature. These surfaces are also assumed to be grey with a constant emissivity $\varepsilon=\alpha$=Constant Value ("cte"), $\rho=1-\alpha$, the gas is assumed to be transparent to the radiation of the walls.

It is possible to use, for each one of the surfaces involved, the equation of radiosity in order to govern these exchanges:

$$\phi_{net} = \text{Surface} \times (\text{Radiosity} - \text{Incident flux}) = S \times (J - E) \tag{6}$$

where:

E designates the lighting (or incident flux) and

J designates the radiosity that is expressed as $(\varepsilon\sigma T^4+\rho E)$;

$S_{Surface}$ designates the area of the surface involved;

$\phi_{net}$ means the net flow received by this surface.

As such, advantageously, the calculation at the step B of the physical parameters p(t), $T_{gas}(t)$, and $T_{liq}(t)$ can be carried out according to the steps defined as follows.

- the temperature of the liquid phase $T_{liq}(t)$ and of the gaseous phase $T_{gas}(t)$ are directly determined using the power conversion equation, with as input data the thermal capacities of the natural gas in liquid state and of the natural gas in the gaseous state, the thermal insulation of the tank defined by the manufacturer of the tank and the temperatures at the instant t−δt of the LNG and of the GNG,
- the mass of liquid evaporated in the gaseous phase is determined by the relationship (5) according to the temperature of the liquid and the pressure determined in the preceding step at the instant t−δt:

$$q_{ev}=K\cdot(\Delta T_{overheat})^{\alpha} \quad (7)$$

with:

- K designating a constant relative to the LNG and always being positive,
- $\Delta T_{overheat}$ designating the overheating that is produced during the evaporation phenomenon in the tank of LNG,
- $q_{ev}$ designating the standardised evaporation rate of LNG, and
- α designating a coefficient relative to the LNG, with $1\leq\alpha\leq2$;
- a coefficient relative to the LNG, with $1\leq\alpha\leq2$;

- the pressure p(t) of the gaseous phase is obtained by the Peng-Robinson equation, with as input data the evaporated mass of liquid, the volume of the tank and the temperature of the gas at the instant t.

During the step C of the algorithm of the method according to the invention, the calculation of the step B is reiterated, by restarting, for the following instant t+δt (with a constant physical time step δt), the mass and power conservation equations as long as the pressure p(t) is less than $p_{valve}$. This time step δt can be of about one minute. Its value depends on the heat flows, time constants of the thermodynamic equilibriums.

As soon as during the N iterations of the process of calculating p(t), p(t+δt), . . . , p(t+N*δt), the pressure p(t+N*δt) of the gaseous phase at the instant t+N*δt becomes greater than or equal to the opening pressure of the valves $p_{valve}$, the algorithm is finished (step D) and returns the total durations travelled by the algorithm (step E), which is equal to the total duration N*δt elapsed by the algorithm at the moment of the stoppage of the calculation.

An operator, knowing this duration can deduce therefrom the duration of autonomy of the tank, i.e. the remaining retention time (or storage time) of a LNG in the tank before opening of the valves of the tank.

Advantageously, in the method according to the invention, all of the steps A to D are reiterated as soon as the time interval ΔT (defined according to the technology of the calculator) has elapsed in order to recalculate the duration of autonomy at the instant $t_0+\Delta T$. Typically, this time interval can be about 1 minute, but could vary according to the technology used (calculator, Man-Made Interface ("MMI" interface) in particular).

Advantageously, the algorithm (or behaviour code NG) of the method according to the invention can be implemented by means of a calculator connected to a MMI interface that makes it possible to inform an operator as to this duration of autonomy. Thanks to the calculator connected to a MMI interface, a physical calculation of the duration of autonomy could be carried out at all time intervals ΔT (variable according to the technology used, for example every minute) and the result of this calculation can be transmitted to the MMI.

As indicated hereinabove, different types of data must be supplied to the calculator:

- data concerning the tank (to be entered only one time by the user):
  - shape of the tank (prismatic, cylindrical, spherical, etc.),
  - dimensions of the tank,
  - boil off rate (or BOR) of the tank,
  - evaluation of the heat inputs (data from the manufacturer), and
  - the calibration of the valves $p_{valve}$.
- composition of the NG (to be entered at the beginning of the loading of the tank or use of an average composition), and
- data provided by the sensors (continuously): Temperature of the gas and of the liquid and Pressure of the gas.

This invention therefore also has for object a system for calculating in real time the duration of autonomy of a non-refrigerated tank, wherein the algorithm is implemented by means of a calculator that calculates the duration of autonomy of the tank, with the tank being defined by a set pressure of the valves $p_{valve}$, its shape and its dimensions, as well as its boil off rate, said system according to the invention comprising:

- a tank containing liquefied natural gas divided into:
  - a layer of natural gas in liquid state, defined at a given instant t by its temperature $T_{liq}(t)$, its composition $x_{liq}(t)$, and the filling rate of the tank by said natural gas layer; and
  - a natural gas layer in gaseous state, defined at a given instant t by its temperature $T_{gas}(t)$ and its composition $x_{gas}(t)$, and a pressure p(t);
- pressure and temperature sensors, said system being characterised in that it further comprises:

- a calculator connected to said pressure and temperature sensors, said calculator being able to execute the algorithm of the method such as defined according to the invention,
- a MMI interface interacting with said calculator, to report to an operator the duration of autonomy calculated according to the algorithm (or behaviour code LNG) of the method according to the invention when it is implemented by means of a calculator connected to a MMI interface.

In terms of MMI interfaces (acronym meaning Man-Machine Interface) that can be used in the framework of this invention, it is possible in particular to mention the dashboards of vehicles, computer keyboards, LED indicator lights, touch screens, and tablets.

According to an advantageous embodiment of the system according to the invention, said system according to the invention is an onboard system wherein:

- the calculator is an onboard calculator connected to said pressure and temperature sensors, said calculator being specifically designed to execute the algorithm of the method according to the invention,
- the MMI interface can also be on board or alternatively offset if for example the vehicle is connected to a central control.

This MMI interface, if it is on board, can be of the onboard dashboard type of a vehicle, interacting specifically with said onboard calculator to report to the operator (here the driver) the duration of autonomy calculated according to the method of the invention.

The term calculator specifically designed to execute the algorithm of the method according to the invention means, in terms of this invention, an onboard computer comprising a processor associated with a dedicated storage memory and with a motherboard of interfaces; with all of these elements being assembled in such a way as to ensure the robustness of the "onboard computer" unit in terms of mechanical, thermodynamic and electromagnetic resistance, and as such allow for the adaptation thereof to a use in LNG vehicles.

Concretely, the calculator can further include a screen and a keyboard. It is connected to two sensors, one of pressure and one of temperature, which provide the information of the state of the LNG inside the tank (see FIG. 1).

The system according to the invention is shown in FIG. 2.

This invention also has for object a vehicle (land, sea or air) comprising a LNG tank and a system according to the invention, the tank and the system being such defined hereinabove. The duration of autonomy, which is the information of interest to the operator (for example the driver of the vehicle or a remote operator), can for example be advantageously displayed on the dashboard of a vehicle and/or on the side of the vehicle.

This invention therefore has the following multiple advantages:

having retention duration information for any LNG tank instantaneously.

taking account of the quality of the LNG in the calculation, which is not the case with the current standards where the pure methane serves as a reference.

being able to manage unbalanced LNG.

reporting on the compressibility of the tank roof.

Other advantages and particularities of this invention shall result from the following description, provided as a non-limiting example and made in reference to the annexed figures.

Figure 1:
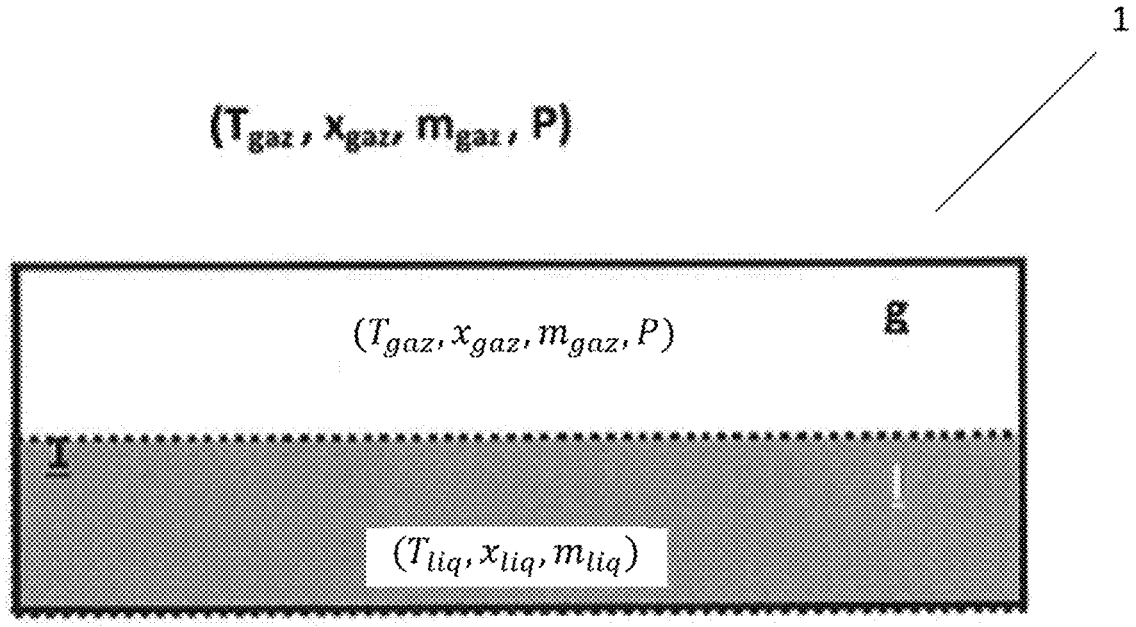
FIG. 1 shows a block diagram of a tank 1 of NG according to the invention.

FIG. 1 diagrammatically shown a tank 1 of LNG, which is modelled by a two-layer system with two homogenous layers of NG, a liquid layer 1 (LNG) and a gaseous g layer (GNG).

Figure 2:
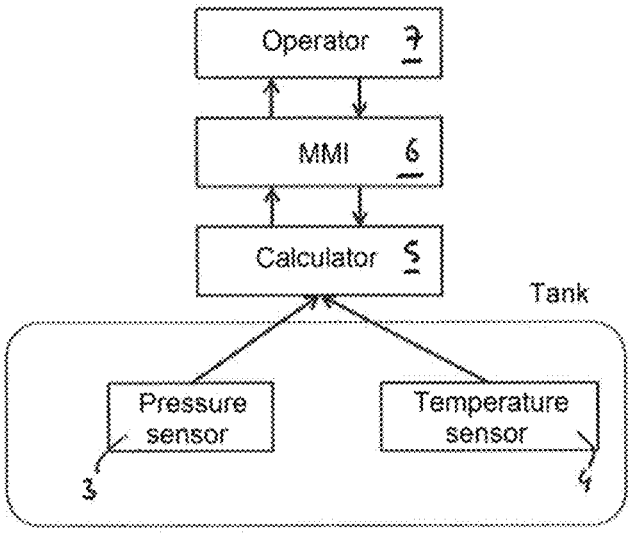
FIG. 2 shows a block diagram of the system according to the invention.

FIG. 2 is a block diagram of the system according to the invention, comprising:

a tank 1 containing liquefied natural gas being divided into a layer of natural gas in liquid state l ($T_{liq}$ (t), $x_{liq}$ (t), and filling rate z of the tank 1 by the layer of natural gas in the liquid state);

a layer of natural gas g in the gaseous state g ($T_{gas}$(t), $x_{gas}$(t) and p(t);

pressure 3 and temperature 4 sensors, a calculator 5 connected to said pressure 3 and temperature 4 sensors, the calculator being able to execute the algorithm of the method such as defined according to claim 4, a MMI interface 6 interacting with the calculator, to report to a given operator 7 the duration of autonomy calculated according to the method of claim 4.

Figure 3:
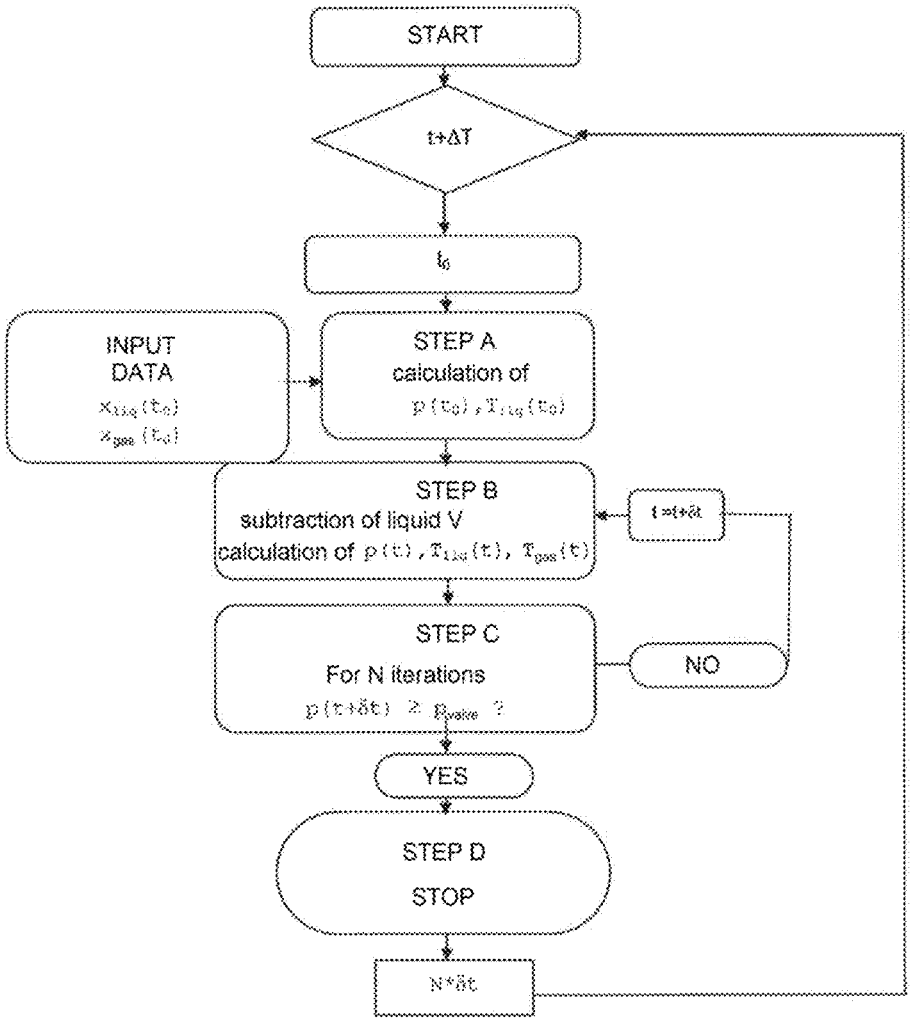
FIG. 3 shows a block diagram of the method according to the invention.

FIG. 3 is a block diagram of the method according to the invention, showing the various steps of the method as described hereinabove.

FIGS. 4 to 8 are screen captures of dashboards of vehicles each transporting a non-refrigerated tank of LNG.

Figure 4:
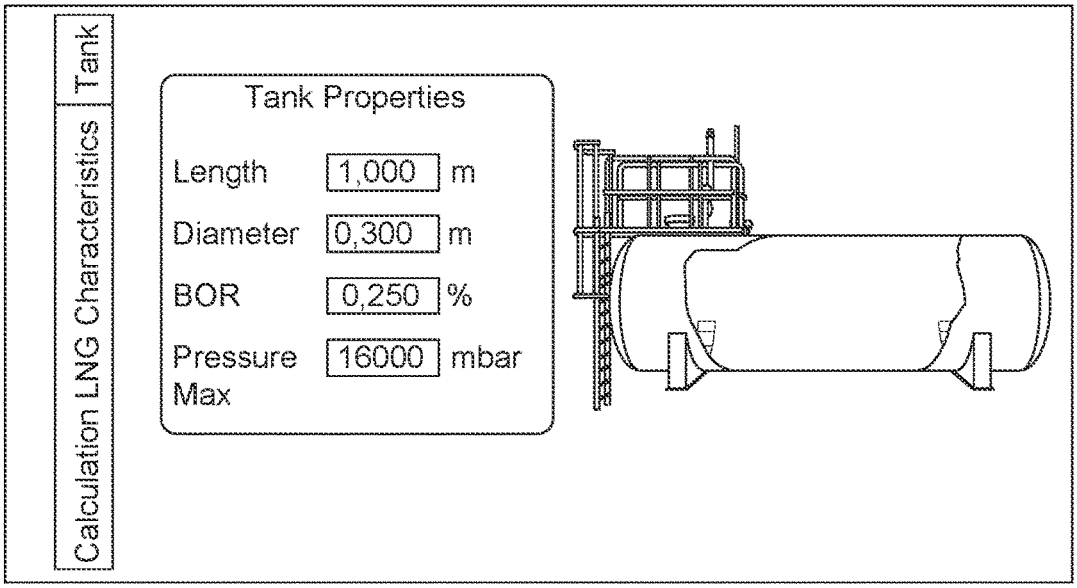
FIGS. 4 to 8 are screen captures of dashboards of vehicles each transporting an unrefrigerated tank of N.

In particular, FIG. 4 is a screen capture of a dashboard showing the input data specific to the tank (dimensions, boil off rate, maximum allowable pressure). This data is common to all of the examples described hereinafter.

Figure 5:
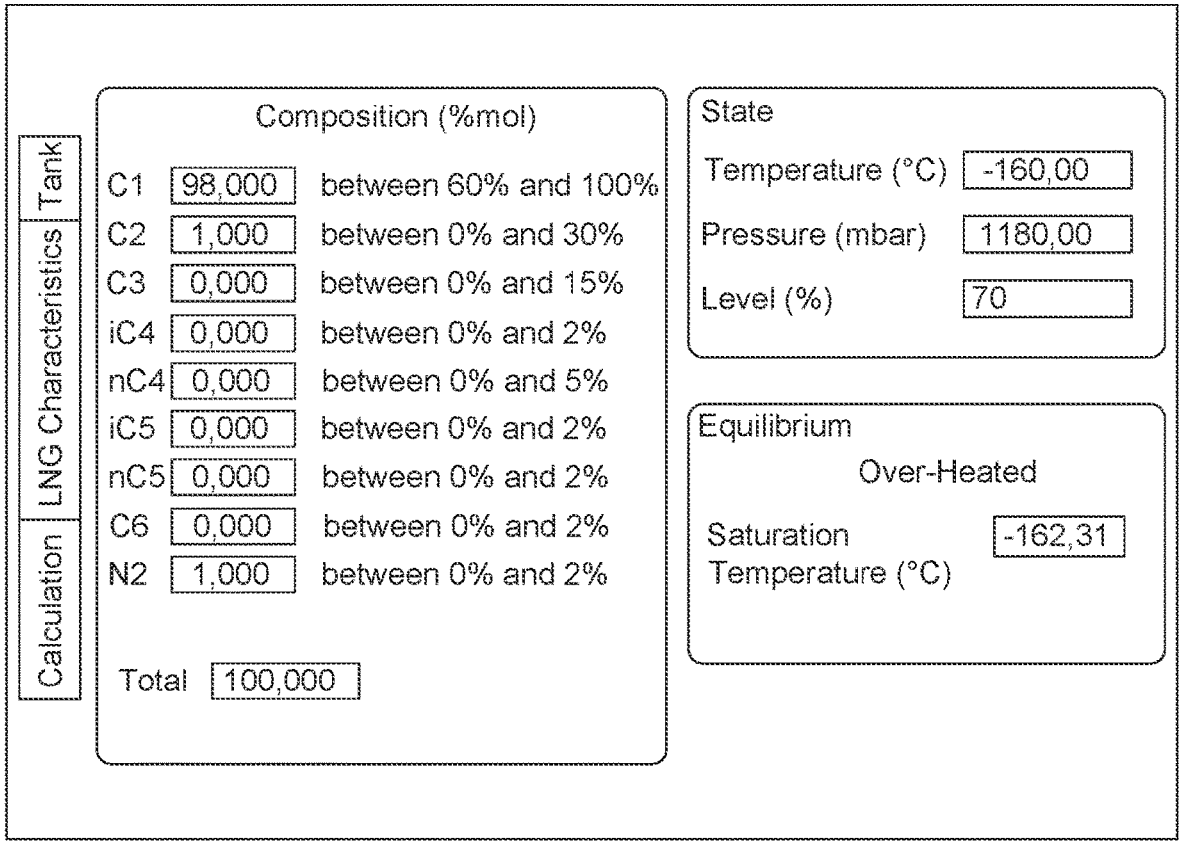

FIG. 5 is a screen capture of a dashboard showing, for a first example of calculation according to the method of calculation according to the invention, the input data specific to an LNG (composition, temperature, pressure and filling rate z. In this example, the LNG is slightly overheated: temperature of −160° C. although the equilibrium temperature for this LNG is −162.31° C.

Figure 6:
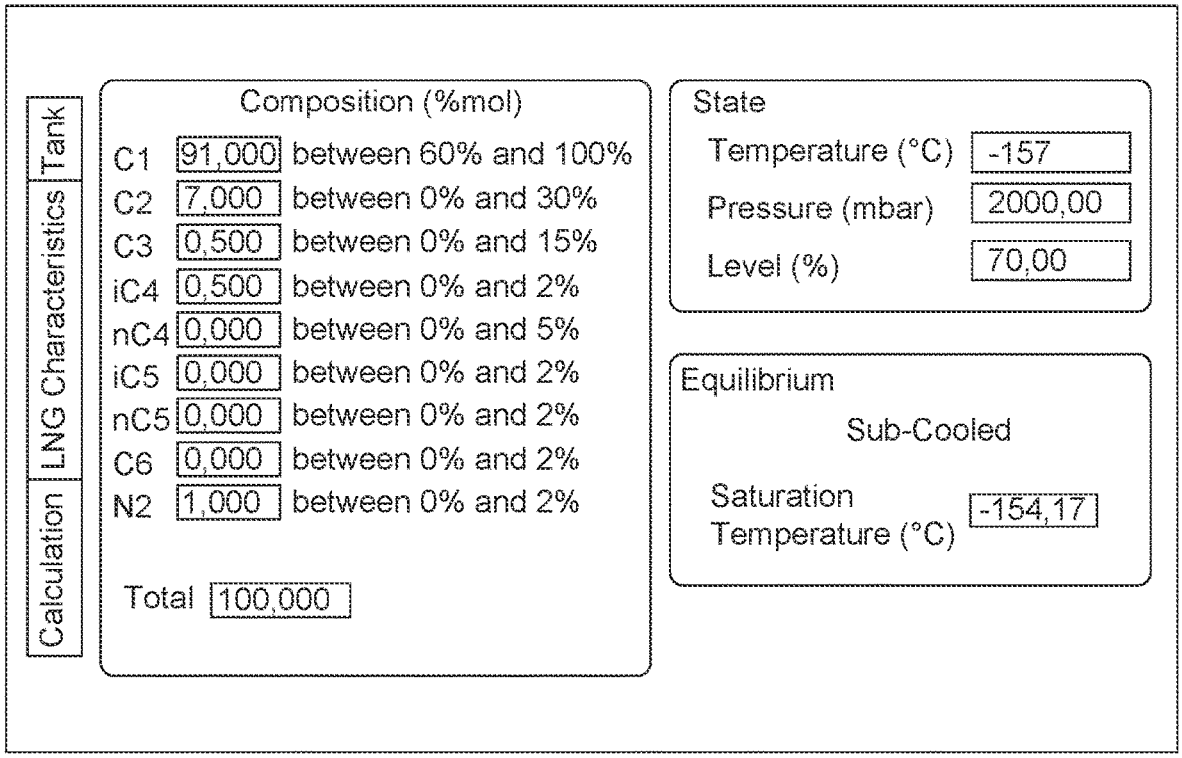

FIG. 6 is a screen capture of a dashboard showing, for a second calculation example according to the method of calculation according to the invention, the input data specific to an LNG (composition, temperature, pressure and filling rate z. In this example, the LNG is slightly sub-cooled: temperature of −157° C. while the equilibrium temperature for, this LNG is −154.17° C.

Figure 7:
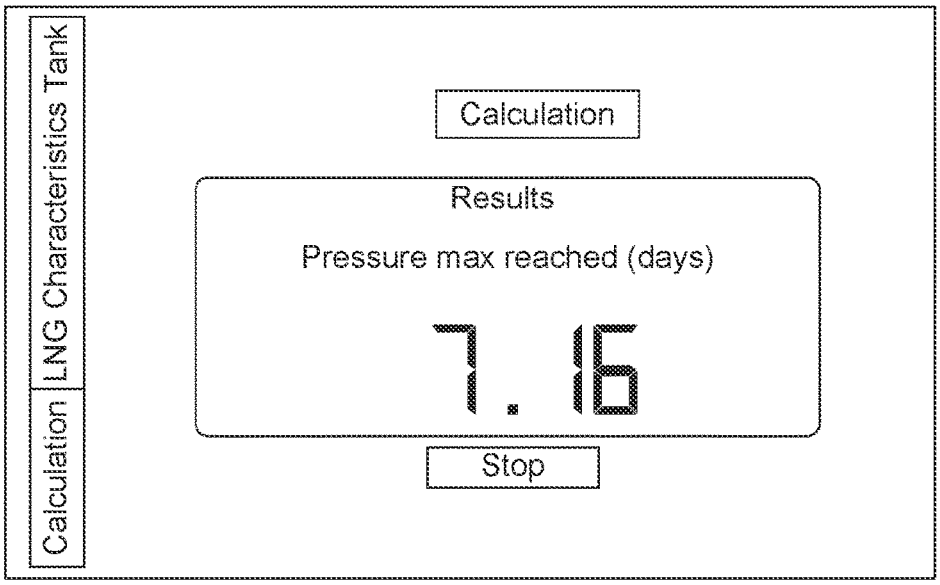
Figure 8:
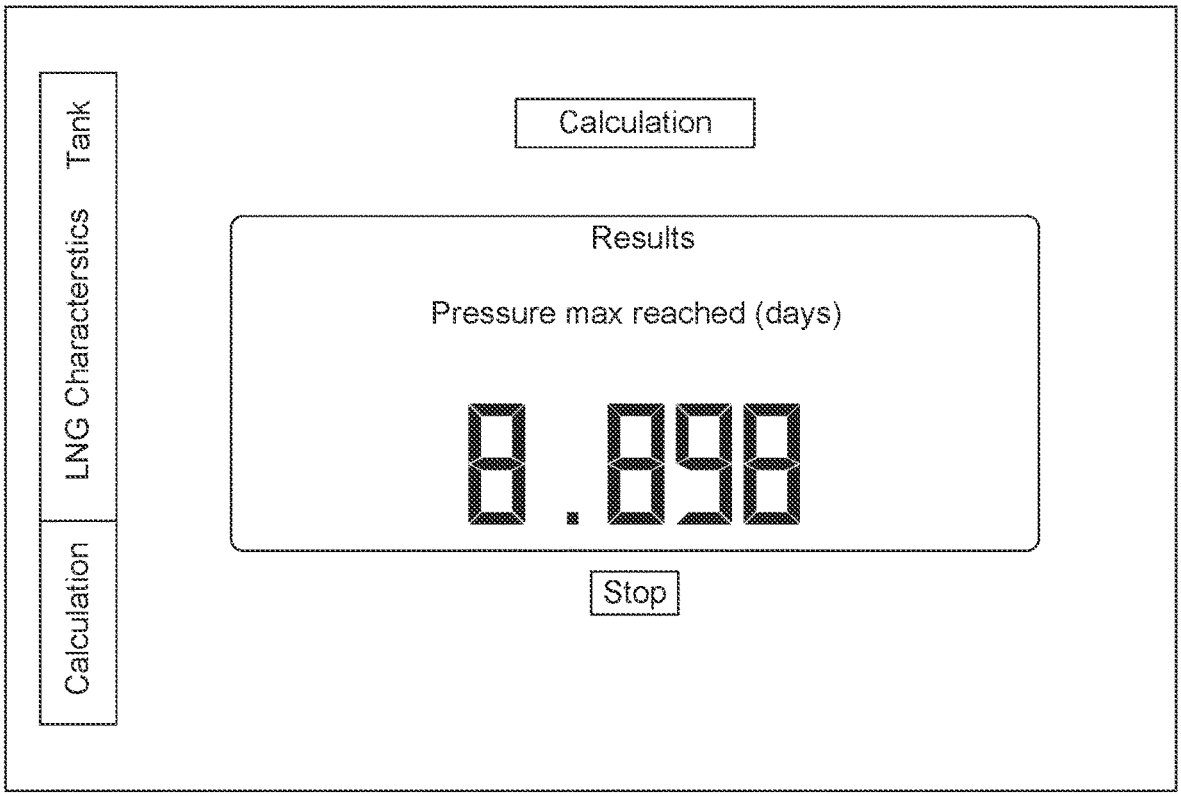

FIGS. 7 and 8 are screen captures giving, respectively for each one of the first (data of FIGS. 4 and 5) and second examples (data of FIGS. 4 and 6), the calculated duration of autonomy of the non-refrigerated tank transported by the vehicle.

LIST OF REFERENCES

[1] Peng, D. Y. (1976). A New Two-Constant Equation of State. *Industrial and Engineering Chemistry: Fundamentals,* 15: 59-64.

[2] H. T Hashemi, H. W. (1971). CUT LNG STORAGE COSTS. *Hydrocarbon Processing,* 117-120.

The invention claimed is:

1. A method for calculating in real-time the duration of autonomy of a non-refrigerated tank and defined by a set pressure of the valves $p_{valve}$, its shape and its dimensions, as well as its boil off rate, said tank being included in a vehicle that further comprises a system comprising means of a calculator that calculates the duration of autonomy of the tank, said calculator being connected to a Man-Machine Interface that makes it possible to inform an operator as to this duration of autonomy, said tank containing natural gas divided into:

a layer of natural gas in liquid state (l), defined at a given instant t by its temperature $T_{liq}$(t), its composition $x_{liq}$(t), and the filling rate of the tank by said natural gas layer;

a natural gas layer in gaseous state (g), defined at a given instant t by its temperature $T_{gas}$(t) and its composition $x_{gas}$(t), and a pressure p(t);

said method being characterized in that it consists of an algorithm comprising the following steps:

a) at an instant t0, physical parameters of said natural gas layers are initialized, by measuring using pressure and temperature sensors, the pressure of the gas p(t0), and the temperature of the liquid $T_{liq}$(t0); while the respective compositions of the liquid $x_{liq}$(t0) and gaseous $x_{gas}$(t0) phases are known input data corresponding either to the respective compositions of the liquid and gaseous phases at the time of the loading of the tank, or to average compositions for the type of liquefied natural gas layer used;

b) for each instant t greater than t0, a predetermined volume of natural gas in the gaseous or liquid state is subtracted from the tank containing the natural gas, said predetermined volume corresponding to the operating state of the tank at this instant t; and a calculation is made, based on the volume of natural gas remaining after subtraction, of physical parameters p(t), $T_{gas}(t)$, and $T_{liq}(t)$, using equations based on the conservation of the mass and of the energy of the liquid and gaseous natural gas contained in the tank;

c) as long as the pressure p(t) is less than $p_{valve}$, the calculation of the step b is reiterated for the following instant t+δt, with a constant physical time step δt;

d) as soon as during the N iterations of the calculation process of p(t), p(t+δt), . . . , p(t+N*δt), the pressure p(t+N*δt) becomes greater than or equal to $p_{valve}$, the calculation is stopped;

e) the duration of autonomy sought is equal to the total duration N*δt elapsed by the algorithm at the moment of the stoppage of the calculation.

2. The method according to claim 1, wherein all of the steps a-d are reiterated as soon as time interval ΔT has elapsed, in order to recalculate the duration of autonomy at the instant $t_0+\Delta T$.

3. The method according to claim 1, wherein the calculation at the step b of the physical parameters p(t), Tgas(t), and Tliq(t) is carried out according to the steps defined as follows the temperature of the liquid phase $T_{liq}(t)$ and of the gaseous phase $T_{gas}(t)$ are directly determined using a power conversion equation, with as input data the thermal capacities of the natural gas in liquid state and of the natural gas in the gaseous state, the thermal insulation of the tank defined by the manufacturer of the tank and the temperatures at the instant t−δt of the liquid liquefied natural gas layer and of the gaseous liquefied natural gas layer, the mass of liquid evaporated in the gaseous phase is determined by the relationship according to the temperature of the liquid and the pressure determined in the preceding step at the instant t−δt:

$$q_{ev}=K\cdot(\Delta T_{overheat})^{\alpha}$$

with:

designating a constant relative to the liquefied natural gas layer and always being positive, $\Delta T_{overheat}$ designating the overheating that is produced during the evaporation phenomenon in the tank of liquefied natural gas layer, $q_{ev}$ designating the standardized evaporation rate of liquefied natural gas layer, and α designating a coefficient relative to the liquefied natural gas layer, with $1\leq\alpha\leq2$;

the pressure p(t) of the gaseous phase is obtained by the Peng-Robinson equation, with as input data the evaporated mass of liquid, the volume of the tank and the temperature of the gas at the instant t.

4. A system for calculating in real time, according to the method of claim 3, the duration of autonomy of a non-refrigerated tank and defined by a set pressure of the valves $p_{valve}$, its shape and its dimensions, as well as its boil off rate, said system comprising:

a tank containing liquefied natural gas divided into:

a layer of natural gas in liquid state, defined at a given instant t by its temperature $T_{liq}(t)$, its composition $x_{liq}(t)$, and the filling rate of the tank by said natural gas layer in the liquid state;

a natural gas layer in gaseous state, defined at a given instant t by its temperature $T_{gas}(t)$ and its composition $x_{gas}(t)$ and a pressure p(t);

pressure and temperature sensors, said system being characterized in that it is an onboard system further comprising:

an onboard calculator (5) connected to said pressure (3) and temperature (4) sensors, said calculator being designed to execute the algorithm of the method, wherein the algorithm is implemented by means of a calculator that calculates the duration of autonomy of the tank, said calculator being connected to a Man-Machine Interface that makes it possible to inform an operator as to this duration of autonomy, the Man-Machine Interface (6), of the onboard dashboard type of a vehicle, interacting specifically with said onboard calculator (5), to report to an operator (7) the duration of autonomy calculated by means of a calculator connected to the Man-Machine Interface that makes it possible to inform the operator as to this duration of autonomy.

* * * * *